US009695738B2

(12) United States Patent
Kurata et al.

(10) Patent No.: US 9,695,738 B2
(45) Date of Patent: Jul. 4, 2017

(54) UNIFLOW TWO-STROKE ENGINE

(71) Applicant: HONDA MOTOR CO., LTD., Tokyo (JP)

(72) Inventors: Mashu Kurata, Tokyo (JP); Toru Kawai, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 133 days.

(21) Appl. No.: 14/640,644

(22) Filed: Mar. 6, 2015

(65) Prior Publication Data

US 2015/0260082 A1 Sep. 17, 2015

(30) Foreign Application Priority Data

Mar. 11, 2014 (JP) ..... 2014-047283

(51) Int. Cl.

| | |
|---|---|
| ***F02B 33/04*** | (2006.01) |
| ***F02B 25/02*** | (2006.01) |
| ***F02F 1/22*** | (2006.01) |
| ***F02B 25/04*** | (2006.01) |
| ***F02B 25/20*** | (2006.01) |
| ***F02F 7/00*** | (2006.01) |
| ***F01M 11/08*** | (2006.01) |
| *F01M 1/08* | (2006.01) |

(52) U.S. Cl.

CPC ..... *F02B 25/02* (2013.01); *F01M 11/08* (2013.01); *F02B 25/04* (2013.01); *F02B 25/20* (2013.01); *F02F 1/22* (2013.01); *F02F 7/0036* (2013.01); *F01M 1/08* (2013.01)

(58) Field of Classification Search

CPC ..... F02B 25/02; F02B 25/20; F02B 25/04; F01M 11/08; F01M 1/08; F02F 7/0036; F02F 1/22

USPC ..... 123/73 R, 73 A, 73 B, 65 PD, 65 W, 123/65 WA, 65 P

See application file for complete search history.

(56) References Cited

U.S. PATENT DOCUMENTS

| | | | | | |
|---|---|---|---|---|---|
| 2,054,963 | A * | 9/1936 | Attealander | F02B 25/00 | 123/65 VC |
| 2,137,344 | A * | 11/1938 | McCarthy | F02B 31/00 | 123/308 |
| 2,573,989 | A * | 11/1951 | Sammons | F02B 25/00 | 123/41.84 |
| 3,411,289 | A * | 11/1968 | Antonsen | F01B 7/14 | 123/51 BA |
| 6,263,841 | B1 * | 7/2001 | Beveridge | F02B 33/04 | 123/65 A |

(Continued)

FOREIGN PATENT DOCUMENTS

| | | |
|---|---|---|
| JP | 5039790 B2 | 10/2012 |
| WO | 2008/066448 A1 | 6/2008 |

*Primary Examiner* — Marguerite McMahon

(74) *Attorney, Agent, or Firm* — Westerman, Hattori, Daniels & Adrian, LLP

(57) ABSTRACT

A uniflow two-stroke engine, includes: a cylinder receiving a piston such that the piston can reciprocate therein; an exhaust port provided in an upper end part of the cylinder; and a scavenging port that is provided in a lower side wall portion of the cylinder so as to be opened and closed by the piston, wherein a downstream portion of the scavenging port that opens out to the cylinder includes a guide member that gives a downward velocity component to a gas flow entering the cylinder from the scavenging port.

7 Claims, 8 Drawing Sheets

(56) References Cited

U.S. PATENT DOCUMENTS

| | | | | |
|---|---|---|---|---|
| 2003/0005895 | A1* | 1/2003 | Carlsson | F02B 25/14<br>123/73 A |
| 2007/0079779 | A1* | 4/2007 | Martinsson | F02B 25/22<br>123/73 PP |
| 2010/0170485 | A1* | 7/2010 | Bram | F01M 3/00<br>123/73 R |

* cited by examiner

E
A
6
II
5
1
43B
34
43
33
32
31
28
29
4
23
3
24
23A
18A
21
19
18
64
16
2D
59
66
59
55
60
56
26
22
2
8
25
8C
2E
53
54
68
2A
8B
II

E
A
33
43B
43
5
6
32
34
29
43A
30
52
1
4
31
28
23
23A
21
18A
51
18
19
3
16
24
55
55
56
56
2
42
60
22
26
41
71
56
71
2B
8C
47
7
46
8D
8E
25
8
8B
8B
8A
13
13
8A
2A
45
11
7
2C
12

UNIFLOW TWO-STROKE ENGINE

TECHNICAL FIELD

The present invention relates to a uniflow two-stroke engine.

BACKGROUND OF THE INVENTION

A uniflow two-stroke engine that includes an exhaust port provided in an upper end part of the cylinder and a scavenging port provided in a lower side wall portion of the cylinder is known. The scavenging port is opened and closed by the piston reciprocating in the cylinder. In this engine, when the piston moves downward, the air-fuel mixture in the crank chamber is compressed and the scavenging port is opened, whereby the air-fuel mixture in the crank chamber flows into the cylinder via the scavenging port. At the same time, the exhaust port is opened, so that the exhaust gas (combustion gas) in the cylinder is pushed out through the exhaust port by the entering air-fuel mixture. At this time, if the layer of air-fuel mixture flowing into the cylinder and the layer of the exhaust gas are not mixed with each other and the a clear boundary therebetween is maintained, it is possible to discharge only the exhaust gas via the exhaust port. However, part of the air-fuel mixture is mixed with the exhaust gas or has a velocity higher than that of the exhaust gas, so that the part of the air-fuel mixture is discharged through the exhaust port to the outside together with the exhaust gas, which phenomenon is known as "blow-by." The blow-by of the air-fuel mixture is not favorable in view of fuel consumption and environmental pollution.

To address such a problem, there is an engine having an air-fuel mixture separator disposed on a path passing the scavenging port (see JP5039790B, for example). In this engine, the air-fuel mixture is caused to pass through a centrifugal-type separator and separated into a fuel-rich flow and a fuel-lean flow, which are supplied to the cylinder via different passages. Thus, by using the fuel-lean air-fuel mixture to perform the scavenging, it is possible to decrease the concentration of fuel discharged through the exhaust port.

However, the engine relating to JP5039790B is not configured to maintain a clear boundary between the exhaust gas layer and the air-fuel mixture layer, and therefore, though it is possible to reduce the fuel concentration in the air-fuel mixture discharged through the exhaust port, the air-fuel mixture is still discharged to the outside. Further, it is necessary to control the timings to supply the fuel-rich flow and the fuel-lean flow separated by the centrifugal separator to the cylinder, and this makes the control complex.

In view of the aforementioned background, an object of the present invention is to suppress the blow-by of the air-fuel mixture in a uniflow two-stroke engine with a simple structure.

SUMMARY OF THE INVENTION

To achieve the above object, the present invention provides a uniflow two-stroke engine (E), including: a cylinder (22) receiving a piston (23) such that the piston can reciprocate therein; an exhaust port (31) provided in an upper end part of the cylinder, and a scavenging port (56) that is provided in a lower side wall portion of the cylinder so as to be opened and closed by the piston, wherein a downstream portion (56B) of the scavenging port that opens out to the cylinder includes a guide member (56C, 56D) that gives a downward velocity component to a gas flow entering the cylinder from the scavenging port.

According to this structure, the gas flow entering the cylinder from the scavenging port flows in a direction opposite to the exhaust port in an initial phase in which the gas flow has a high velocity to impinge upon the top of the piston and the inner wall of the cylinder so that the velocity is reduced, and thereafter, changes its direction to flow toward the exhaust port. Thereby, mixing of the gas flow with the exhaust gas in the cylinder is suppressed and, the gas flow is restrained from reaching the exhaust port earlier than the exhaust gas. This ensures a clear boundary between the layer of the exhaust gas and the layer of the gas supplied from the scavenging port inside the cylinder, and makes it possible to discharge the exhaust gas more reliably while restraining the gas supplied from the scavenging port from flowing out through the exhaust port more reliably.

In the aforementioned invention, preferably, the guide member consists of an upper wall surface defining an upper part of the scavenging port and is inclined to slope downward toward a downstream side.

According to this structure, the gas flow passing through the scavenging port is guided by the upper wall surface to flow downward toward the downstream side, and thereby, has a downward velocity component when flowing into the cylinder.

Further, in the aforementioned invention, preferably, the upper wall surface continues smoothly to an upper edge (55A) of an open end (55) of the scavenging port connected to the cylinder.

According to this structure, because the upper wall surface that guides the gas flow continues smoothly to the upper edge of the open end, the gas flow guided to flow downward can flow into the cylinder smoothly.

Further, in the aforementioned invention, preferably, the guide member consists of a lower wall surface (56D) defining a lower part of the scavenging port and is inclined to slope downward toward a downstream side.

According to this structure, the gas flow passing through the scavenging port is guided by the lower wall surface to flow downward toward the downstream side, and thereby, has a downward velocity component when flowing into the cylinder.

Further, in the aforementioned invention, preferably, the lower wall surface continues smoothly to a lower edge (55B) of an open end (55) of the scavenging port connected to the cylinder.

According to this structure, because the lower wall surface that guides the gas flow continues smoothly to the lower edge of the open end, the gas flow guided to flow downward can flow into the cylinder smoothly.

Further, in the aforementioned invention, preferably, the scavenging port has an upstream portion (56A) extending upward from the crank chamber on a radially outer side of the cylinder, and an upper end part of the upstream portion is located higher than an upper edge (55A) of an open end (55) of the scavenging port connected to the cylinder.

According to this structure, because the downstream portion of the scavenging port is inclined to slope downward toward the downstream side (cylinder side), a downward velocity component can be easily given to the gas flow supplied from the scavenging port to the cylinder.

Further, in the aforementioned invention, preferably, the downstream portion of the scavenging port extends in a circumferential direction on a radially outer side of the cylinder.

According to this structure, it is possible to ensure an adequate length of the downstream portion of the scavenging port without increasing the size of the engine. By ensuring an adequate length of the downstream portion, it can be ensured that the guide member has an adequate length in the direction of flow, and this enables the guide member to give a downward velocity component more reliably to the gas flow entering the scavenging port. Further, the gas flow supplied from the scavenging port to the cylinder has a circumferential velocity component and makes a swirl flow. As the gas flow forms a swirl flow inside the cylinder, the gas flow fills the cylinder from the lower part of the cylinder, pushing out the layer of the exhaust gas upward. Thereby, a gas flow moving straight from the scavenging port to the exhaust port is suppressed, whereby mixing of the layer of the exhaust gas and the layer of the gas flow supplied from the scavenging port is suppressed and the phenomenon that the gas flow supplied from the scavenging port reaches the exhaust port before the exhaust gas is discharged is avoided.

According to the foregoing structure, it is possible to suppress the blow-by of the air-fuel mixture in a uniflow two-stroke engine with a simple structure.

DETAILED DESCRIPTION OF THE PREFERRED EMBODIMENTS

In the following, a detailed description will be made of an embodiment of the present invention with reference to the drawings, in which the present invention is applied to a single cylinder, uniflow two-stroke engine (hereinafter referred to as an engine E).

(Schematic Structure of the Engine)

Figure 1:
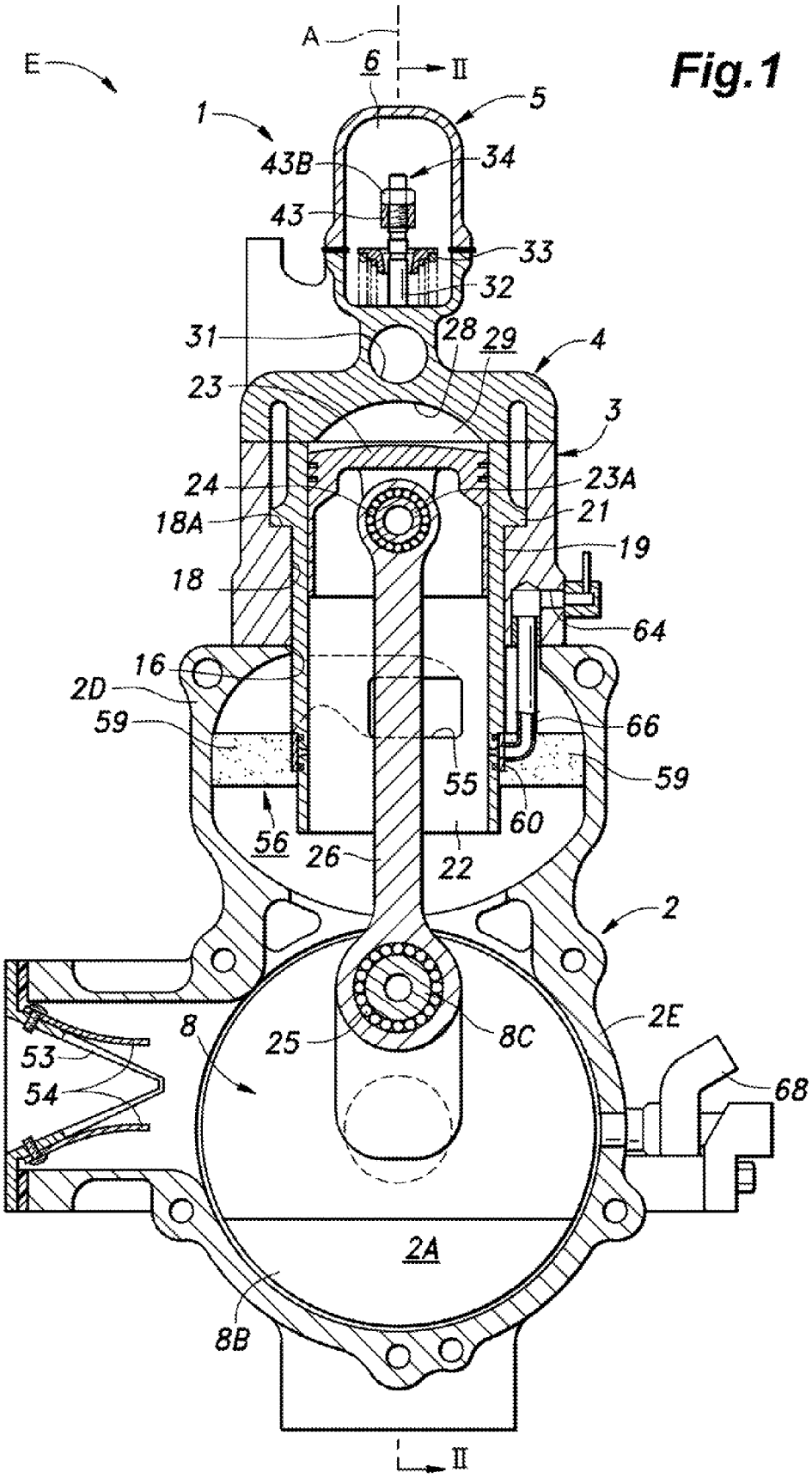
FIG. 1 is vertical cross-sectional view of an engine according to an embodiment of the present invention.
Figure 2:
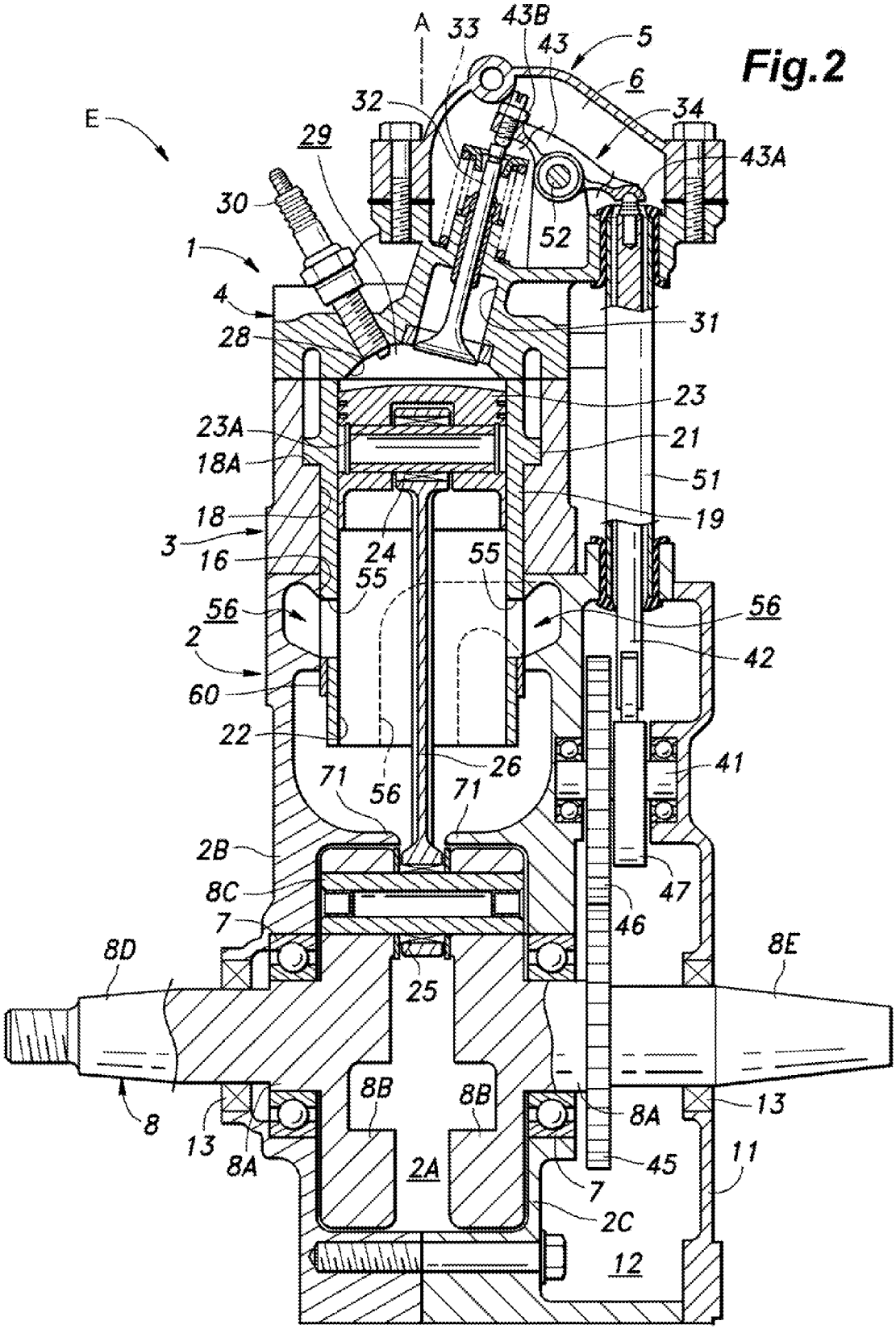
FIG. 2 is a cross-sectional view taken along line II-II in FIG. 1.

As shown in FIG. 1 and FIG. 2, an engine main body 1 of the engine E includes a crankcase 2 defining a crank chamber 2A therein, a cylinder block 3 attached to an upper part of the crankcase 2, a cylinder head 4 attached to an upper part of the cylinder block 3, and a head cover 5 attached to an upper part of the cylinder head 4 and defining an upper valve chamber 6 between itself and the cylinder head 4.

As shown in FIG. 2, the crankcase 2 is constituted of a pair of crankcase halves which are parted laterally by a vertically extending surface (a surface passing the cylinder axis A). The left and right crankcase halves are fastened to each other by bolts and define the crank chamber 2A therebetween. The left and right side walls 2B, 2C of the crankcase 2 rotatably supports a crankshaft 8 via bearings 7.

The crankshaft 8 includes a pair of journals 8A supported by the side walls 2B, 2C of the crankcase 2, a pair of crank webs 8B provided between the journals 8A, and a crankpin 8C supported by the crank webs 8B at a position radially offset from the journals 8A.

An end plate 11 is secured on an outer surface side of the right side wall 2C. The end plate 11 is secured to the outer surface of the right side wall 2C at a periphery thereof and defines a lower valve chamber 12 between itself and the right side wall 2C. The left end portion 8D of the crankshaft 8 passes through the left side wall 2B of the crankcase 2 and extends out to the left. The right end portion 8E of the crankshaft 8 passes through the right side wall 2C of the crankcase 2 and the end plate 11 and extends out to the right. A seal member 13 is provided at each of the part where the left end portion 8D of the crankshaft 8 passes through the left side wall 2B and the part where the right end portion 8E of the same passes through the end plate 11 to ensure an air tight seal of the crank chamber 2A.

The upper part of the crankcase 2 has a first sleeve reception bore 16 formed therein, where the first sleeve reception bore 16 extends vertically, has an upper end that opens out at the upper end surface of the crankcase 2 and a lower end that opens out to the crank chamber 2A, and has a circular cross section.

The cylinder block 3 extends vertically and is fastened to the upper end surface of the crankcase 2 at the lower end surface thereof. The cylinder block 3 is provided with a second sleeve reception bore 18 that extends vertically therethrough from the upper end surface to the lower end surface. The second sleeve reception bore 18 is a stepped bore having a circular cross section, where an upper part of the second sleeve reception bore 18 is given a larger diameter than a lower pan such that an upward-facing annular shoulder surface 18A is defined at the interface between the upper part and the lower part. The lower end opening of the second sleeve reception bore 18 is aligned coaxially with the upper end opening of the first sleeve reception bore 16 of the cylinder block 3 and is connected with the same. The first sleeve reception bore 16 and the lower part of the second sleeve reception bore 18 have the same inner diameter so as to form a continuous bore.

Press-fitted into the first and second sleeve reception bores 16, 18 is a cylinder sleeve 19 having a cylindrical shape. The cylinder sleeve 19 is provided on its outer circumference with an annular projection 21 that projects radially outward. The projection 21 abuts the shoulder surface 18A to determine the position of the cylinder sleeve 19 relative to the first and second sleeve reception bores 16, 18. The lower end of the cylinder sleeve 19 protrudes downward from the lower end opening of the first sleeve reception bore 16 and makes a protruding end inside the crank chamber 2A. The upper end of the cylinder sleeve 19 is positioned so as to be flush with the upper end surface of the cylinder block 3 and abuts the lower end surface of the cylinder head 4 joined to the cylinder block 3. Thereby, the cylinder sleeve 19 is interposed between the shoulder surface 18A and the lower surface of the cylinder head 4, and the position thereof in the direction of the cylinder axis A is determined. The inner bore of the cylinder sleeve 19 forms a cylinder 22.

The cylinder 22 receives a piston 23 such that the piston 23 can reciprocate therein. The piston 23 has a piston pin 23A extending in parallel with the crankshaft 8. The piston pin 23A pivotably supports the small end of a connecting rod 26 via a bearing 24. The large end of the connecting rod 26 is pivotably supported by the crankpin 8C via a bearing 25. As the piston 23 and the crankshaft 8 are connected by the connecting rod 26, the reciprocating movement of the piston 23 is converted to the rotational movement of the crankshaft 8.

As shown in FIG. 1 and FIG. 2, a hemispherical combustion chamber recess 28 is formed at a part of the lower end surface of the cylinder head 4 corresponding to the cylinder sleeve 19. The combustion chamber recess 28 defines a combustion chamber 29 between itself and the top surface of the piston 23 and constitutes an upper end portion of the cylinder 22.

The cylinder head 4 is provided with a spark plug 30 so as to face the combustion chamber 29. Further, the cylinder head 4 is provided with an exhaust port 31 opening out at the tope end of the combustion chamber 29 and an exhaust valve 32 consisting of a poppet valve to selectively close and open the exhaust port 31. The exhaust valve 32 has a stem end disposed in the upper valve chamber 6 and is urged by a valve spring 33 in the closing direction. The exhaust valve 32 is opened and closed by a valve actuating mechanism 34 in synchronization with the rotation of the crankshaft 8.

As shown in FIG. 2, the valve actuating mechanism 34 includes a camshaft 41 that rotates in response to the rotation of the crankshaft 8, a pushrod 42 driven to advance and retreat by the camshaft 41, and a rocker arm 43 driven by the pushrod 42 and pushes the exhaust valve 32 in the opening direction. The camshaft 41 is disposed in the lower valve chamber 12 in parallel with the crankshaft 8. The camshaft 41 has one end rotatably supported by the right side wall 2C of the crankcase 2 and the other end rotatably supported by the end plate 11. The crankshaft 8 has a crank gear 45 at a part located in the lower valve chamber 12, and the camshaft 41 has a cam gear 46 engaging the crank gear 45. The gear ratio between the crank gear 45 and the cam gear 46 is 1:1. The camshaft 41 is provided with a cam 47 consisting of a plate cam.

The pushrod 42 is received in a tubular rod case 51 having open ends so as to be capable of advancing and retreating. The rod case 51 extends vertically, and the lower end thereof is joined to the right side wall 2C of the crankcase 2 and in communication with the lower valve chamber 12 while the upper end thereof is joined to the cylinder block 3 and in communication with the upper valve chamber 6. The pushrod 42 is in contact with the cam 47 of the camshaft 41 at its lower end, and advances and retreats in response to the rotation of the camshaft 41. It is also possible to provide the lower end of the pushrod 42 with a roller, so that the pushrod 42 is in rolling contact with the cam 47 via the roller.

The rocker arm 43 is pivotably supported by a rocker shaft 52 supported by the cylinder head 4. The rocker shaft 52 extends in a direction perpendicular to the cylinder axis A and the axis of the crankshaft 8. The rocker arm 43 has at one end thereof a receiving pan 43A in contact with the upper end of the pushrod 42 and has at the other end thereof a screw adjuster 43B in contact with the stem end of the exhaust valve 32.

With the valve actuating mechanism 34 having the foregoing structure, each time the crankshaft 8 makes one revolution, the exhaust valve 32 is opened once at a predetermined timing.

As shown in FIG. 1, the front side wall 2D of the crankcase 2 is provided with an intake port 53, which is an opening in communication with the crank chamber 2A. The intake port 53 is located in front of the crankshaft 8 and extends in the fore and aft direction toward the crankshaft 8. An intake passage not shown in the drawings is connected to the external end of the intake port 53. The intake port 53 is provided with a reed valve 54 that permits the flow of fluid from the intake port 53 toward the crank chamber 2A while prohibiting the flow of fluid from the crank chamber 2A toward the intake port 53. The reed valve 54 is normally closed, and opens when the piston 23 moves upward and the internal pressure in the crank chamber 2A thereby drops.

A part of the cylinder sleeve 19 inside the first sleeve reception bore 16 is provided with scavenging orifices 55 each extending through the cylinder sleeve 19 in the radial direction. The vertical dimension of each scavenging orifice 55 is selected to be smaller than that of the outer circumference of the piston 23. A scavenging port 56 that communicates the crank chamber 2A and the scavenging orifices 55 with each other is defined in the upper part of the crankcase 2 along a periphery of the first sleeve reception bore 16. The scavenging orifices 55 serve as a downstream end of the scavenging port 56. The scavenging orifices 55 (scavenging port 56) are opened and closed by the reciprocating movement of the piston 23. Specifically, when the piston 23 is at a position corresponding to the scavenging orifices 55, the scavenging port 56 is closed by the outer circumference of the piston 23, when the lower edge of the piston 23 is located higher than the lower edge 55B of the scavenging orifices 55 (on the side of the top dead center), the scavenging port 56 is opened so as to be in communication with the part of the cylinder 22 below the piston 23, and when the upper edge of the piston 23 is located lower than the upper edge 55A of the scavenging orifices 55 (on the side of the bottom dead center), the scavenging port 56 is opened so as to be in communication with the part of the cylinder 22 above the piston 23.

Figure 3:
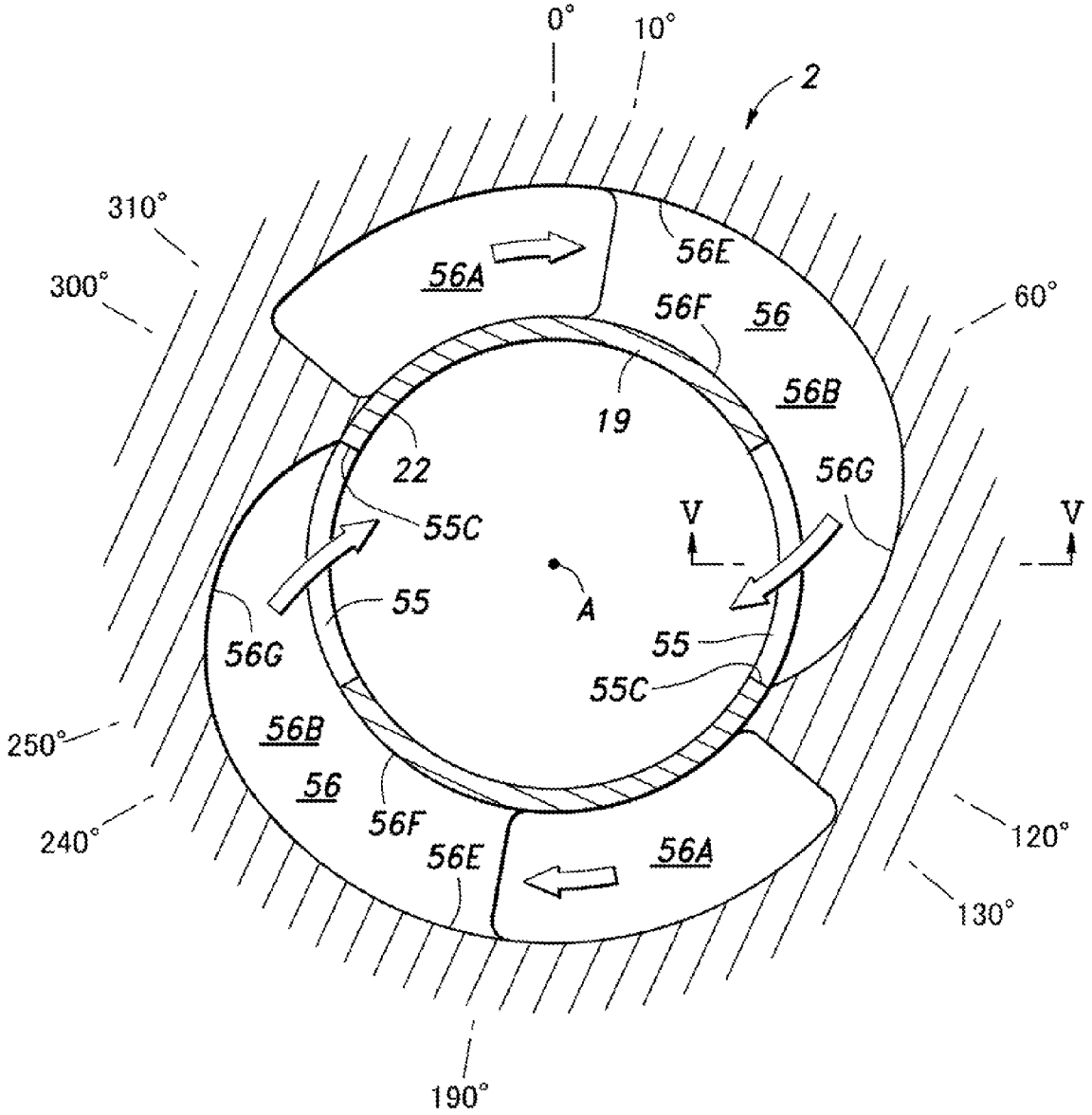
FIG. 3 is a cross-sectional view taken along line III-III in FIG. 1.

As shown in FIG. 3, in the present embodiment, the engine E has a pair of scavenging ports 56 and a pair of scavenging orifices 55. The scavenging ports 56 and the scavenging orifices 55 in each pair have a rotationally symmetric shape about the cylinder axis A and are disposed at 180 degrees rotationally symmetric positions.

Figure 4:
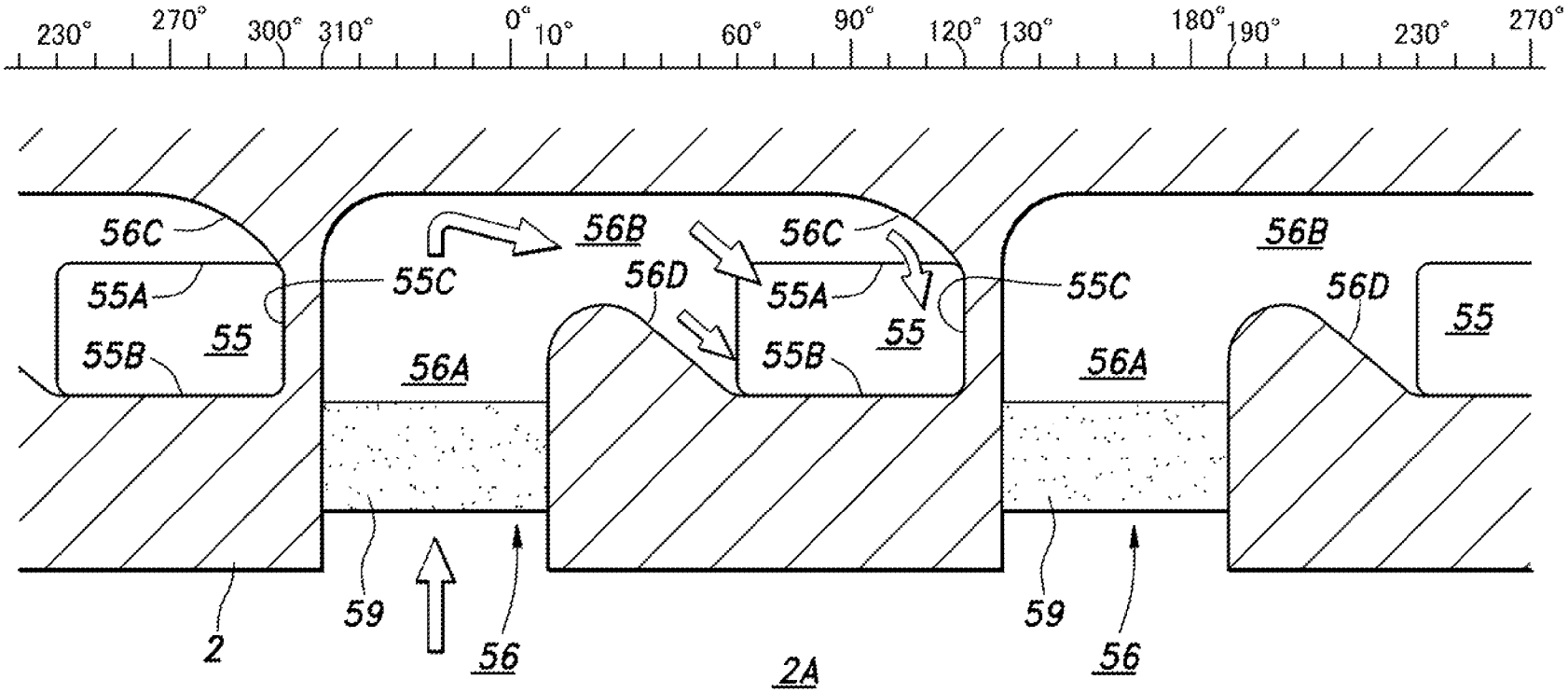
FIG. 4 is a schematic diagram of a scavenging port developed in the circumferential direction around a cylinder axis A.

FIG. 4 is a schematic diagram of the scavenging port 56 developed in the circumferential direction around the cylinder axis A. As shown in FIG. 1 and FIG. 4, an upstream portion 56A of each scavenging port 56 has a lower end in communication with the crank chamber 2A and extends upward from the lower end in parallel with the cylinder axis A on a radially outer side of the cylinder sleeve 19. The upper end of the upstream portion 56A is positioned higher than the upper edge 55A of the scavenging orifices 55.

A downstream portion 56B of each scavenging port 56 extends obliquely downward from the upper end of the upstream portion 56A toward the scavenging orifice 55 to give a downward velocity component to the gas flow passing through the scavenging orifice 55 into the cylinder 22. Specifically, an upper wall surface 56C of the downstream portion 56B formed by a passage member (crankcase 2) constitutes an inclined surface that slopes downward from the upstream side toward the downstream side. The upper wall surface 56C preferably constitutes a surface that continues smoothly to the upper edge 55A of the scavenging orifice 55 (see FIG. 7). Further, a lower wall surface 56D of the passage member defining a lower part of the downstream portion 56B formed by the passage member (crankcase 2) constitutes an inclined surface that slopes downward from the upstream side toward the downstream side. The lower wall surface 56D preferably constitutes a surface that continues smoothly to the lower edge 55B of the scavenging orifices 55 (see FIG. 7).

FIG. 3 and FIG. 4 show the shape of the scavenging ports 56, and the angles shown in these drawings represent corresponding angular positions in FIG. 3 and FIG. 4. As shown in FIG. 3, the downstream portion 56B extends in the circumferential direction from the upper part of the upstream portion 56A to the scavenging orifice 55 on a radially outer side of the cylinder sleeve 19. The downstream portion 56B extends counterclockwise about the cylinder axis A from the upstream side toward the downstream side, as seen from above along the cylinder axis A.

Figure 5:
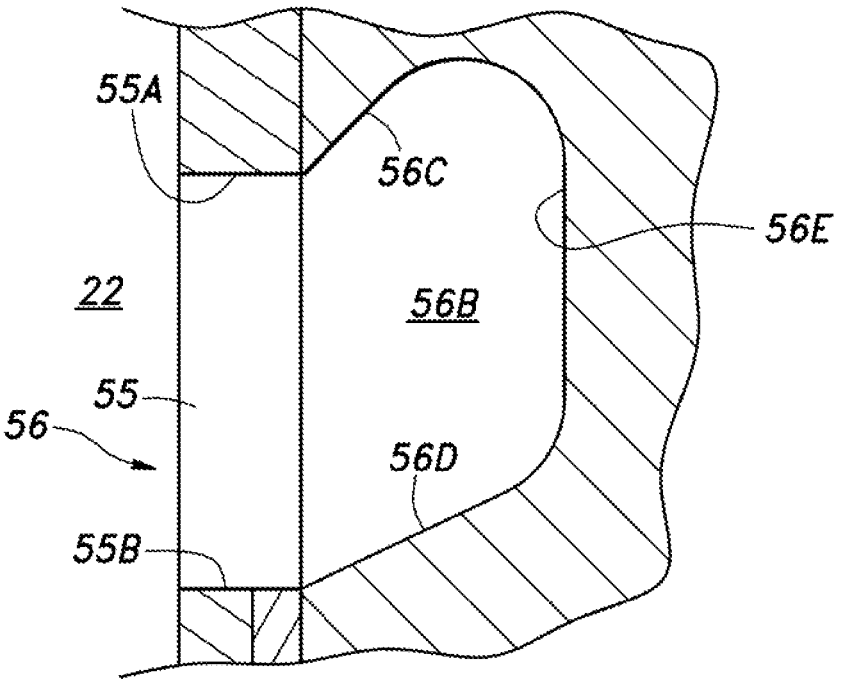
FIG. 5 is a cross-sectional view taken along line V-V in FIG. 3.

As shown in FIG. 4, the downstream portion 56B is inclined in the circumferential direction about the cylinder axis A to slope downward from the upstream side toward the downstream side. Further, as shown in FIG. 5, the downstream portion 56B is inclined in the radial direction with respect to the cylinder axis A to slope downward from the upstream side (radially outer side) toward the downstream side (radially inner side). As shown in FIG. 4 and FIG. 5, the upper wall surface 56C and the lower wall surface 56D are inclined in the circumferential direction about the cylinder axis A to slope downward from the upstream side toward the downstream side, and are also inclined in the radial direction to slope downward from the upstream side toward the downstream side (from the radially outer side toward the radially inner side).

As the downstream portion 56B of each scavenging port 56 is inclined to slope downward toward the downstream side, the gas flow entering the cylinder 22 through the downstream portion 56B and the scavenging orifice 55 has a downward velocity component and flows to the space on top of the piston 23. The upper wall surface 56C and the lower wall surface 56D each constitute a first guide member that gives a downward velocity component to the gas flow entering the cylinder 22 from the scavenging port 56.

As shown in FIG. 3 and FIG. 5, an outer circumferential side wall surface 56E of the passage member which constitutes an outer circumferential side portion of the downstream portion 56B extends in the circumferential direction about the cylinder axis A. An inner circumferential side wall surface 56F constituting an inner circumferential side portion of the downstream portion 56B is formed by an outer circumferential surface of the cylinder sleeve 19 and extends in the circumferential direction about the cylinder axis A. An outer circumferential downstream end portion 56G, which is a part of the outer circumferential side wall surface 56E that continues to the scavenging orifice 55, is inclined relative to the circumferential direction about the cylinder axis A so as to deflect radially inward toward the downstream side. Preferably, the outer circumferential downstream end portion 56G extends substantially in parallel with the tangential direction of the outer circumferential surface of the cylinder sleeve 19 at a side edge 55C of the scavenging orifice 55. Thereby, the gas flow supplied to the inside of the cylinder 22 through the downstream portion 56B is guided by the outer circumferential side wall surface 56E and the outer circumferential downstream end portion 56G to have a circumferential velocity component about the cylinder axis A. As a result, the gas flow forms a swirl flow inside the cylinder 22. The outer circumferential side wall surface 56E and the outer circumferential downstream end portion 56G each constitute a second guide member that gives a circumferential velocity component to the gas flow entering the cylinder 22 from the scavenging port 56.

As shown in FIG. 1 and FIG. 4, each scavenging port 56 is provided with a deceleration member 59 that reduces the velocity of the flowing gas. The deceleration member 59 creates resistance against the gas passing through the scavenging port 56 and reduces the flow velocity of the gas. The deceleration member 59 may include a mesh member or a porous member, which has an air permeability. In this embodiment, a mesh member having a metal mesh, such as a steel wool, for example, is used as the deceleration member 59. The deceleration member 59 is inserted into the upstream portion 56A of the scavenging port 56 and fixed therein. The deceleration member 59 is arranged so as to cover the whole flow path cross section area at an arbitrary position of the scavenging port 56. The deceleration member 59 may be provided in the downstream portion 56B of the scavenging port 56.

As shown in FIG. 1, an annular oil passage forming member 60 is attached to the outer circumference of the lower end part of the cylinder sleeve 19 projecting into the crank chamber 2A. The inner circumference of the oil passage forming member 60 is in surface contact with the outer circumference of the cylinder sleeve 19 in the circumferential direction. The part of the outer circumference of the cylinder sleeve 19 facing the inner circumference of the oil passage forming member 60 is formed with an annular groove that extends annularly in the circumferential direction (reference number is omitted). The annular groove is covered by the oil passage forming member 60 to define an annular channel. The oil passage forming member 60 is provided with an oil inlet hole (reference number is omitted) radially extending therethrough and in communication with the annular groove. The cylinder sleeve 19 is provided with an oil supply hole (reference number is omitted) radially extending therethrough and in communication with the annular groove. Multiple oil supply holes are formed in the circumferential direction of the cylinder sleeve 19.

The cylinder block 3 has a first oil passage 64 formed therein. The first oil passage 64 has one end that opens out at the side surface of the cylinder block 3 and the other end that opens out at the lower end surface of the cylinder block 3. Connected to the open end of the first oil passage 64 that opens out at the lower end surface of the cylinder block 3 is one end of a second oil passage tube 66 that defines a second oil passage. The second oil passage tube 66 extends vertically in the scavenging port 56, and the other end thereof is connected to the oil inlet hole of the oil passage forming member 60. Thereby, the oil press-fed by the oil pump not shown in the drawings passes through the first oil passage 64, the second oil passage tube 66, the oil inlet hole, the annular groove and the oil supply holes in order, and is supplied to the inner wall of the cylinder sleeve 19.

A fuel injection valve 68 is mounted to the rear side wall 2E of the crankcase 2. The tip end of the fuel injection valve 68 is disposed in the crank chamber 2A so as to be directed toward the crankshaft 8. The fuel injection valve 68 injects fuel into the crank chamber 2A at a predetermined timing.

As shown in FIG. 2, on the inner surfaces of the left and right side walls 2B, 2C of the crankcase 2 are provided respective flange portions 71 protruding toward each other. The flange portions 71 are located higher than the upper end of the crank webs 8B when the piston 23 is positioned at the top dead center, so that the flange portions 71 do not interfere with the crankshaft 8. Further, the pair of flange portions 71 is arranged so that a predetermined gap is defined between the tip ends of the flange portions 71 in the left and right direction, whereby they do not interfere with the connecting rod 26.

The engine E having the structure described above operates as follows after start-up. With reference to FIG. 1, first, during the upward stroke of the piston 23, the reed valve 54 opens due to a decrease in pressure in the crank chamber 2A caused thereby, and fresh air flows into the crank chamber 2A. Fuel is injected by the fuel injection valve 68 toward the fresh air that has flowed into the crank chamber 2A, whereby an air-fuel mixture is generated. At the same time, the air-fuel mixture in the upper part of the cylinder 22 is compressed by the piston 23, and, when the piston 23 is near the top dead center, the spark plug 30 performs spark ignition to combust the fuel.

Thereafter, when the piston 23 starts its downward stroke, the reed valve 54 is closed, and the air-fuel mixture in the crank chamber 2A is compressed. As the piston 23 moves downward, the exhaust valve 32 driven by the valve actuating mechanism 34 opens the exhaust port 31 before the piston 23 opens the scavenging port 56. Then, when the piston 23 opens the scavenging orifices 55, the air-fuel mixture compressed in the crank chamber 2A flows into the cylinder 22 (into the combustion chamber 29) through the scavenging port 56. The combustion gas (exhaust gas) in the combustion chamber 29 is discharged through the exhaust port 31 by being pushed out by the air-fuel mixture, and a part thereof remains in the combustion chamber 29 as an internal EGR gas.

When the piston 23 undergoes the upward stroke again, the exhaust valve 32 driven by the cam 47 closes the exhaust port 31 after the piston 23 closes the scavenging port 56, and the air-fuel mixture in the cylinder 22 (combustion chamber 29) is compressed as the piston 23 moves upward. At the same time, the pressure in the crank chamber 2A decreases and fresh air is taken in through the reed valve 54.

In this way, the engine E performs a two-cycle operation. The scavenging flow from the scavenging port 56 to the exhaust port 31 via the cylinder 22 is realized as a uni-flow guided along a relatively straight path.

In the following, a description will be made of the effects of the engine E according to the present embodiment. In the engine E, the downstream portion 56B of each scavenging port 56 includes the upper wall surface 56C and the lower wall surface 56D that are inclined to slope downward toward the downstream side, and thereby, the gas flowing into the cylinder 22 from the scavenging port 56 is guided by the upper wall surface 56C and the lower wall surface 56D to have a downward velocity component (see the white arrows in FIG. 4). As a result, the flow of the air-fuel mixture flowing into the cylinder 22 from the scavenging port 56 flows downward away from the exhaust port 31 in an initial phase in which the air-fuel mixture has a high velocity, and impinges upon the top of the piston 23 and the inner wall of the cylinder sleeve 19, whereby the velocity is reduced. Thereafter, the flow of the air-fuel mixture changes its direction in the cylinder 22 to flow toward the exhaust port 31. Thereby, mixing of the air-fuel mixture with the exhaust gas in the cylinder 22 is suppressed, and the air-fuel mixture is restrained from reaching the exhaust port 31 earlier than the exhaust gas. This ensures a clear boundary between the exhaust gas layer and the air-fuel mixture layer inside the cylinder, and makes it possible to discharge the exhaust gas more reliably while restraining the air-fuel mixture from flowing out though the exhaust port 31 more reliably. Namely, stratified scavenging can be performed more reliably.

In the case where the upper wall surface 56C continues to the upper edge 55A of the scavenging orifices 55 smoothly and the lower wall surface 56D continues to the lower edge 55B of the scavenging orifices 55 smoothly, the flow of the air-fuel mixture guided downward by the upper wall surface 56C and the lower wall surface 56D flows into the cylinder 22 smoothly, while maintaining a downward velocity component.

The downstream portion 56B extends along the circumferential direction on a radially outer side of the cylinder sleeve 19, and thus, it is possible to ensure an adequate length of the downstream portion 561 without increasing the size of the engine main body 1 including the crankcase 2. Further, owing to the downstream portion 56B extending in the circumferential direction, the air-fuel mixture flowing through the downstream portion 56B is given a circumferential velocity component about the cylinder axis A (see the white arrows in FIG. 3), and preferably passes through the scavenging orifice 55 in the tangential direction of the cylinder 22. Thereby, the air-fuel mixture forms a swirl flow inside the cylinder 22. As the air-fuel mixture flowing in the cylinder 22 forms a swirl flow instead of flowing straight upward, mixing of the air-fuel mixture layer with the exhaust gas layer is suppressed and the boundary therebetween can be maintained more clearly.

The deceleration member 59 provided in each scavenging port 56 creates resistance against the air-fuel mixture flowing through the scavenging port 56 and reduces the flow velocity of the air-fuel mixture. Further, the deceleration member 59 has an effect of homogenizing the various velocities included in the flow of the air-fuel mixture. Specifically, the deceleration member 59 reduces a high velocity of the velocities included in the flow of the air-fuel mixture to thereby reduce the variance of the velocity distribution. Thereby, the flow of the air-fuel mixture flowing into the cylinder 22 from the scavenging port 56 is restrained from passing the exhaust gas in the cylinder 22 and reaching the exhaust port 31 earlier than the exhaust gas.

Each of the above-described structures, namely, the structure in which the downstream portion 56B slopes downward from the upstream side toward the downstream side, the structure in which the downstream portion 56B extends in the circumferential direction on an outer side of the cylinder 22, and the structure in which the scavenging port 56 is provided with the deceleration member 59, by itself can suppress mixing of the layer of the exhaust gas with the layer of the air-fuel mixture and can suppress discharge of the air-fuel mixture when discharging the exhaust gas through the exhaust port 31. Thereby, it is possible to reduce the amount of hydrocarbons contained in the gas discharged from the exhaust port 31.

A description of the concreate embodiments has been provided in the foregoing, but the present invention is not limited to the above embodiments and various alterations and modifications are possible. For example, the number and shape of the scavenging ports 56 may be changed as appropriate.

For instance, as the first guide member that gives a downward velocity component to the gas flowing into the cylinder 22 from the scavenging port 56, each of the upper wall surface 56C and the lower wall surface 56D was configured as an inclined surface that slopes downward toward the downstream side in the foregoing embodiment, but in another embodiment, at least one of the upper wall surface 56C and the lower wall surface 56D may be configured as an inclined surface that slopes downward toward the downstream side.

Figure 6:
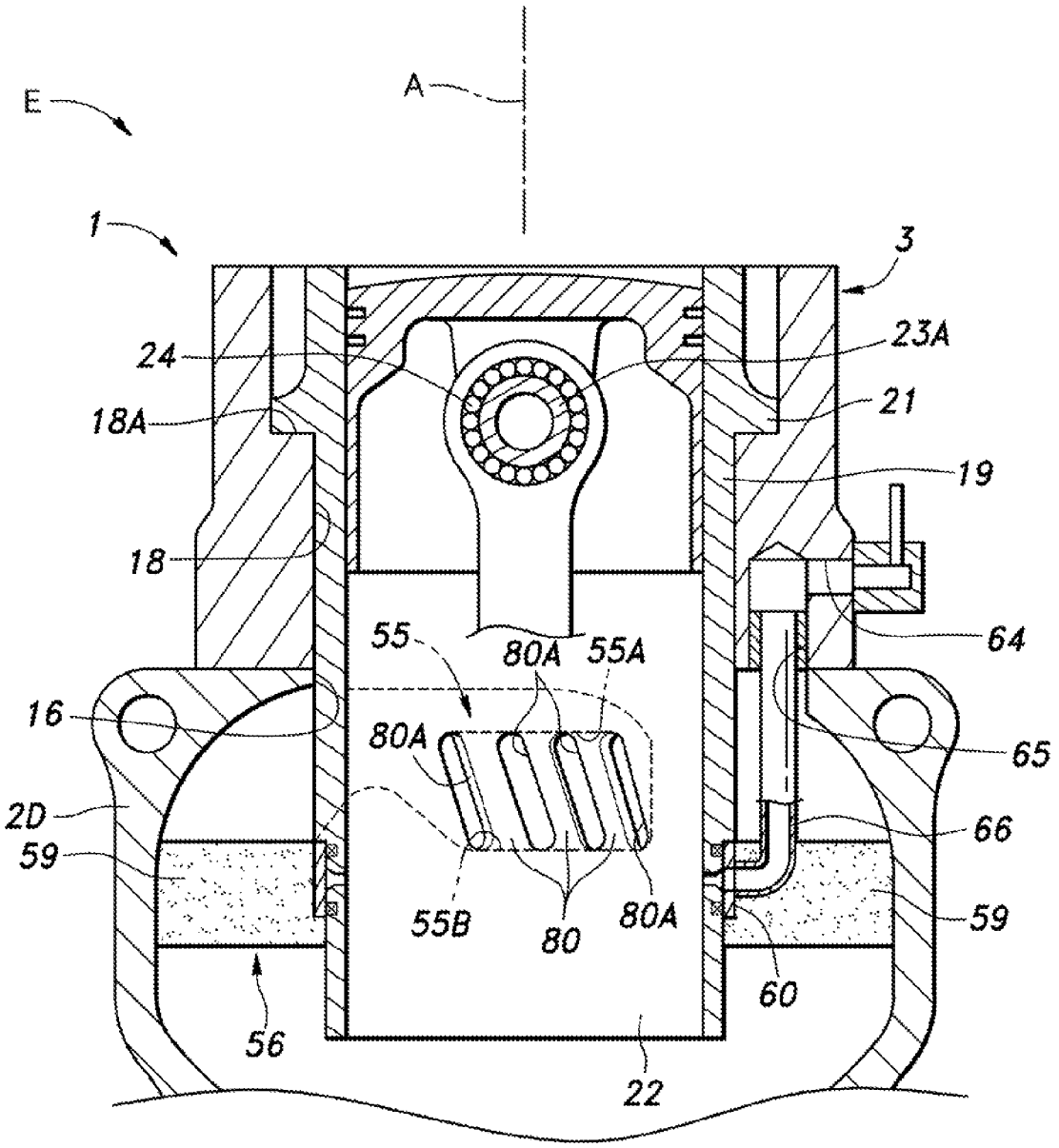
FIG. 6 is an enlarged vertical cross-sectional view showing an essential part of an engine according to a modified embodiment.

As a modification of the scavenging orifice 55, it is possible to provide multiple pillars 80 extending between the upper edge 55A and the lower edge 55B of the scavenging orifice 55 as shown in FIG. 6, such that the scavenging orifice 55 is divided into multiple elongated (slit-shaped) openings 81. In this case, it is preferred that each pillar 80 is inclined with its lower end being displaced relative to its upper end toward the downstream side of the downstream portion 56B so that a side wall surface 80A of each pillar 80 that faces the upstream side in the circumferential direction of the downstream portion 56B faces obliquely downward. Thereby, the side wall surface 80A of the pillar 80 constitutes an inclined surface that slopes downward toward the downstream side in the circumferential direction of the downstream portion 56B. The gas flow entering the downstream portion 56B and passing through the openings 81 can be guided to flow downward or given a downward velocity component by each side wall surface 80A.

Figure 7:
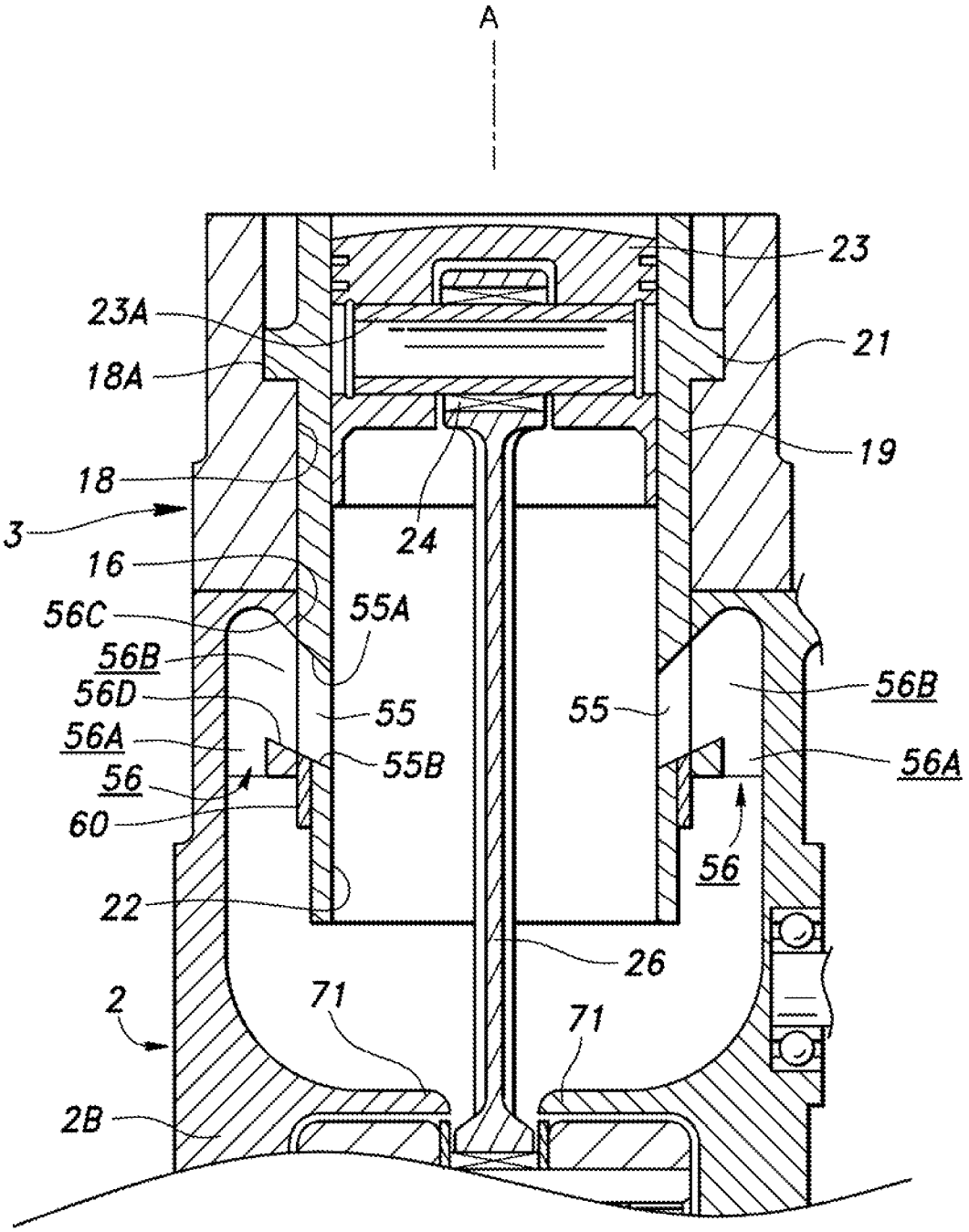
FIG. 7 is an enlarged vertical cross-sectional view showing an essential part of an engine according to a modified embodiment.

Further, as shown in FIG. 7, the downstream portion 56B does not have to extend in the circumferential direction on a radially outer side of the cylinder sleeve 19, but may extend along the radial direction relative to the axis A. In this case also, as in the embodiment, the upper end part of the upstream portion 56A extends to be higher than the upper edge 55A of the scavenging orifices 55, and the downstream portion 56B extends obliquely downward from the upper end of the upstream portion 56A to the scavenging orifice 55. The upper wall surface 56C and the lower wall surface 56D of the downstream portion 56B each preferably constitute a surface that slopes downward toward the downstream side (radially inner side).

Further, as shown in FIG. 7, the upper edge 55A and the lower edge 55B of each scavenging orifice 55 serving as the downstream end of the scavenging port 56 may each consist of an inclined surface that slopes downward toward the cylinder 22. In other words, the upper edge 55A and the lower edge 55B may each consist of an inclined surface that slopes downward in the radially inward direction. The structure in which the upper edge 55A and the lower edge 55B each consist of an inclined surface may be applied not only to the modified embodiment shown in FIG. 7 but also to the embodiment in which the downstream portion 56B extends in the circumferential direction. It is also to be noted that in the embodiment shown in FIG. 7, the upper wall surface 56C continues to the upper edge 55A of the scavenging orifices 55 smoothly and the lower wall surface 561D continues to the lower edge 55B of the scavenging orifices 55 smoothly, whereby the flow of the air-fuel mixture guided downward by the upper wall surface 56C and the lower wall surface 56D flows into the cylinder 22 smoothly, while maintaining a downward velocity component.

Figure 8:
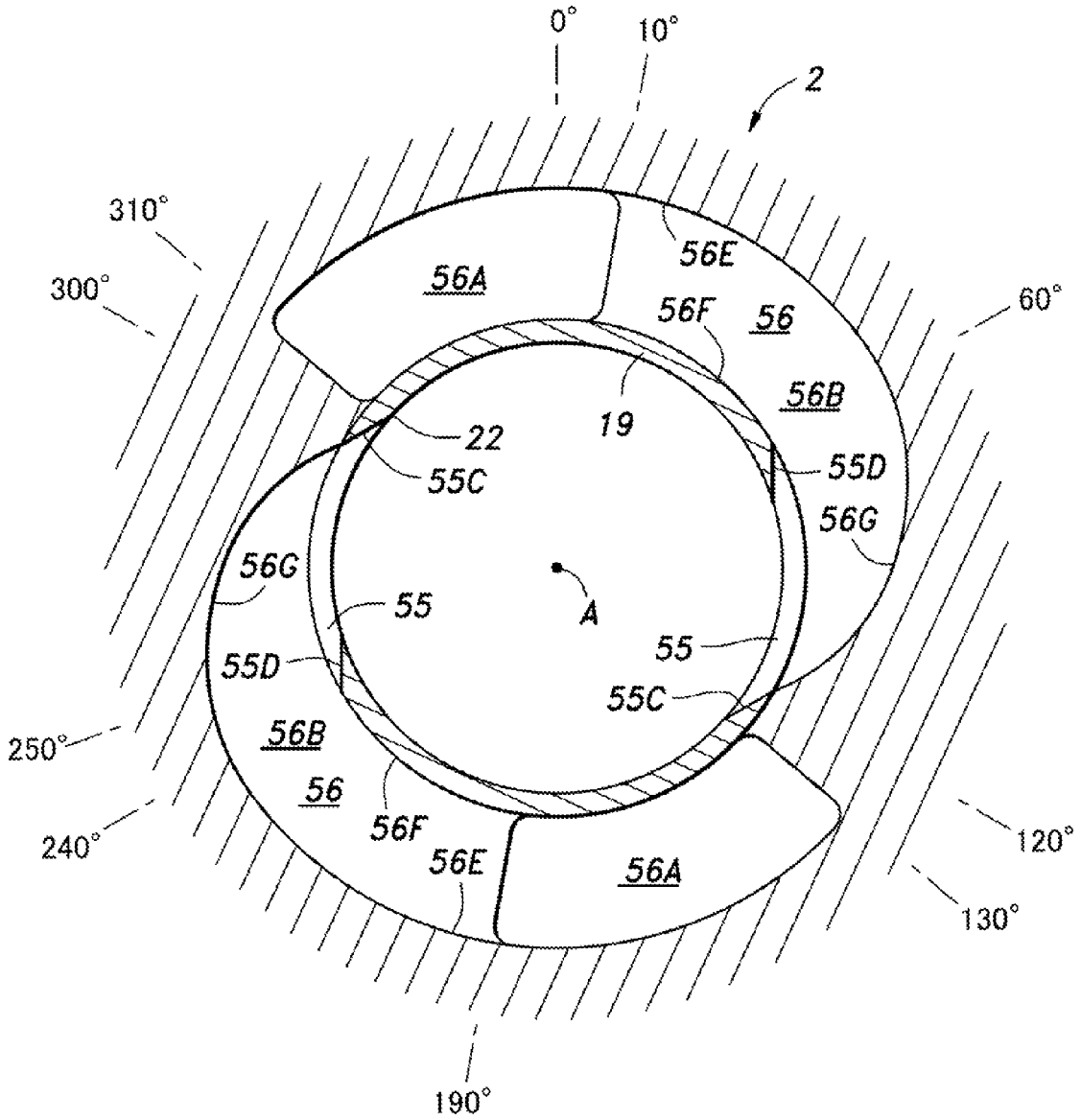
FIG. 8 is a cross-sectional view similar to FIG. 3 and showing an essential part of an engine according to a modified embodiment.

Further, as shown in FIG. 8, the side edge 55C on the downstream side of each scavenging orifice 55 serving as the downstream end of the scavenging port 56 may consist of an inclined surface that extends substantially in the tangential direction of the cylinder 22. Further, the side edge 55D on the upstream side of each scavenging orifice 55 serving as the downstream end of the scavenging port 56 may consist of an inclined surface that extends substantially in the tangential direction of the cylinder 22.

The invention claimed is:

1. A uniflow two-stroke engine, comprising:

a cylinder receiving a piston such that the piston can reciprocate therein;

an exhaust port provided in an upper end part of the cylinder; and a scavenging port that is provided in a lower side wall portion of the cylinder so as to be opened and closed by the piston, wherein a downstream portion of the scavenging port that opens out to the cylinder includes a guide member that gives a downward velocity component to a gas flow entering the cylinder from the scavenging port, the downstream portion of the scavenging port extends in a circumferential direction on a radially outer side of the cylinder, and a scavenging orifice serving as a downstream end of the scavenging port is divided into multiple openings by pillars extending between an upper edge and a lower edge of the scavenging orifice, each pillar being inclined with its lower end being displaced relative to its upper end such that a side wall surface of each pillar that faces an upstream side of the scavenging port faces obliquely downward in the circumferential direction.

2. The uniflow two-stroke engine according to claim 1, wherein the guide member consists of an upper wall surface defining an upper part of the scavenging port and is inclined to slope downward toward a downstream side.

3. The uniflow two-stroke engine according to claim 2, wherein the upper wall surface continues smoothly to an upper edge of an open end of the scavenging port connected to the cylinder.

4. The uniflow two-stroke engine according to claim 1, wherein the guide member consists of a lower wall surface defining a lower part of the scavenging port and is inclined to slope downward toward a downstream side.

5. The uniflow two-stroke engine according to claim 4, wherein the lower wall surface continues smoothly to a lower edge of an open end of the scavenging port connected to the cylinder.

6. The uniflow two-stroke engine according to claim 1, wherein:

the scavenging port has an upstream portion extending upward from the crank chamber on a radially outer side of the cylinder; and an upper end part of the upstream portion is located higher than an upper edge of an open end of the scavenging port connected to the cylinder.

7. A uniflow two-stroke engine, comprising:

a cylinder receiving a piston such that the piston can reciprocate therein;

an exhaust port provided in an upper end part of the cylinder; and a scavenging port that is provided in a lower side wall portion of the cylinder so as to be opened and closed by the piston, wherein a downstream portion of the scavenging port that opens out to the cylinder includes a guide member that gives a downward velocity component to a gas flow entering the cylinder from the scavenging port, the downstream portion of the scavenging port extends in a circumferential direction on a radially outer side of the cylinder, and a scavenging orifice serving as a downstream end of the scavenging port has side edges on downstream and upstream sides thereof, one or both of the side edges of the scavenging orifice consisting of an inclined surface that extends substantially in a tangential direction of the cylinder as viewed in an axial direction of the cylinder.

* * * * *